US006622326B2

(12) United States Patent
Richardson

(10) Patent No.: US 6,622,326 B2
(45) Date of Patent: Sep. 23, 2003

(54) INFLATABLE PILLOW WITH PUMP

(76) Inventor: Kevin Richardson, 22386 Caminito Madera, Laguna Hills, CA (US) 92653

( * ) Notice: Subject to any disclaimer, the term of this patent is extended or adjusted under 35 U.S.C. 154(b) by 0 days.

(21) Appl. No.: 09/912,168

(22) Filed: Jul. 23, 2001

(65) Prior Publication Data

US 2003/0014819 A1 Jan. 23, 2003

(51) Int. Cl.[7] ..... A47G 9/00
(52) U.S. Cl. ..... 5/644; 5/655.3; 5/636
(58) Field of Search ..... 5/644, 655.3, 710, 5/636, 645

(56) References Cited

U.S. PATENT DOCUMENTS 795,108 A * 7/1905 Doellinger ..... 5/644
2,942,281 A * 6/1960 Cole ..... 5/644
3,133,696 A * 5/1964 Mirando ..... 137/846
3,411,164 A 11/1968 Sumergrade
3,864,766 A * 2/1975 Prete, Jr. ..... 5/636
4,277,859 A 7/1981 Seaman
4,528,705 A 7/1985 Greenawalt
4,979,249 A 12/1990 Meade, II
4,984,315 A 1/1991 Ortman et al.
D351,526 S 10/1994 Tarquinio

* cited by examiner

*Primary Examiner*—Teri Pham Luu
*Assistant Examiner*—Fredrick Conley
(74) *Attorney, Agent, or Firm*—James G. O'Neill; Klein, O'Neill & Singh

(57) ABSTRACT

An improved pillow is formed from an internal inflatable bladder having a filling and a lining secured thereto. A pump is secured to the internal inflatable bladder, inside of the filling or lining and a release valve is provided to release air from the pillow. The pump is easily operated by a single hand to inflate the pillow to a desired comfort level.

9 Claims, 3 Drawing Sheets

INFLATABLE PILLOW WITH PUMP

BACKGROUND OF THE INVENTION

1. Field of the Invention

This invention relates generally to pillows, and more particularly, to an improved inflatable pillow having a built-in pump to control the comfort of the pillow.

2. Description of Related Art

Most pillows made, sold and used throughout the world are not useful for all persons. For example, pillows include particle fill material, such as feathers, down, synthetic filament yarn, buckwheat hulls, cherry pits, etc. Both feathers and down fill material in pillows can induce intense head sweats in sleepers and many pillows harbor known allergens, such as dust mites, etc., which can cause allergic symptoms in an estimated 20% of Americans, or roughly 58 million people.

The pillow industry uses standard dimensions for its pillows, depending on the size of the bed on which the pillow is to be used. Additionally, some pillows are capable of being partially blown-up by having bladders therein. However, it is hard to control the inflation of such pillows, and they must be pumped up or deflated using a separate pump or opening a valve. The present pillow invention solves many of the problems with known pillows by utilizing a novel, highly efficient pump built into the pillow to enable a user to easily control the comfort level of the pillow.

Therefore, although the known inflatable pillows solve some of the problems with known pillows, there still exists a need in the art for an inflatable pillow that is more quickly and easily adjusted, and which is easier and less expensive to make.

SUMMARY OF THE INVENTION

Accordingly, it is a general object of the present invention to provide an improved pillow. It is a more particular object of the present invention to provide an improved inflatable pillow. It is a further particular object of the present invention to provide an improved inflatable pillow having a built-in pump. It is a still further particular object of the present invention to provide an improved inflatable pillow having a release valve for releasing air therefrom. It is still another particular object of the present invention to provide an improved inflatable pillow having an outer lining secured thereto. It is yet another particular object of the present invention to provide an improved inflatable pillow having an inner bladder secured to an outer lining and including a built-in pump and a separate release valve.

In accordance with one embodiment of the present invention, an inflatable bladder has an air pump secured at one corner and a release valve at a second corner. The inflatable bladder is covered by an outer lining having filling therein, secured to the bladder.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

Figure 1:
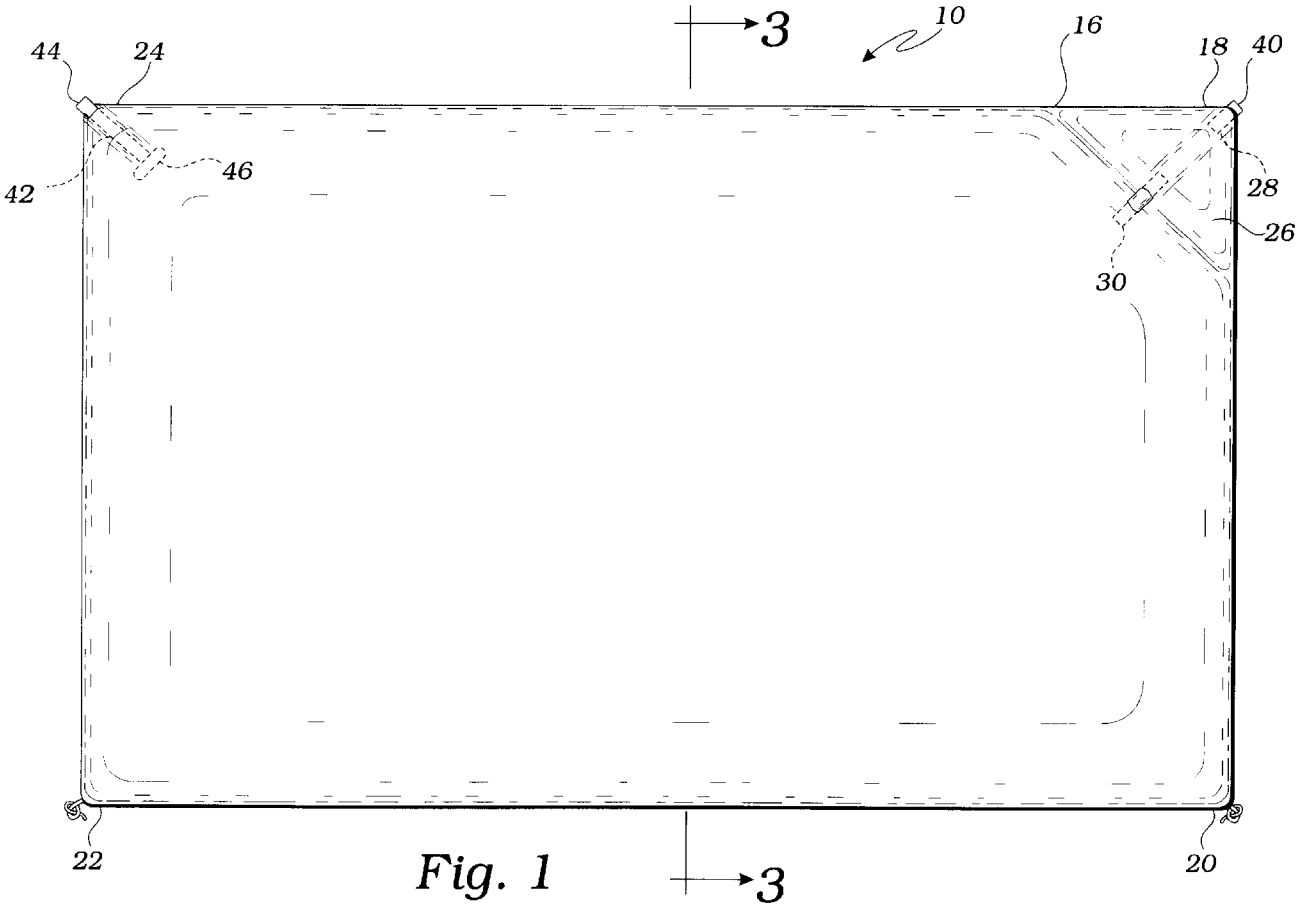
FIG. 1 is a top plan view of an improved inflatable pillow of the present invention.
Figure 2:
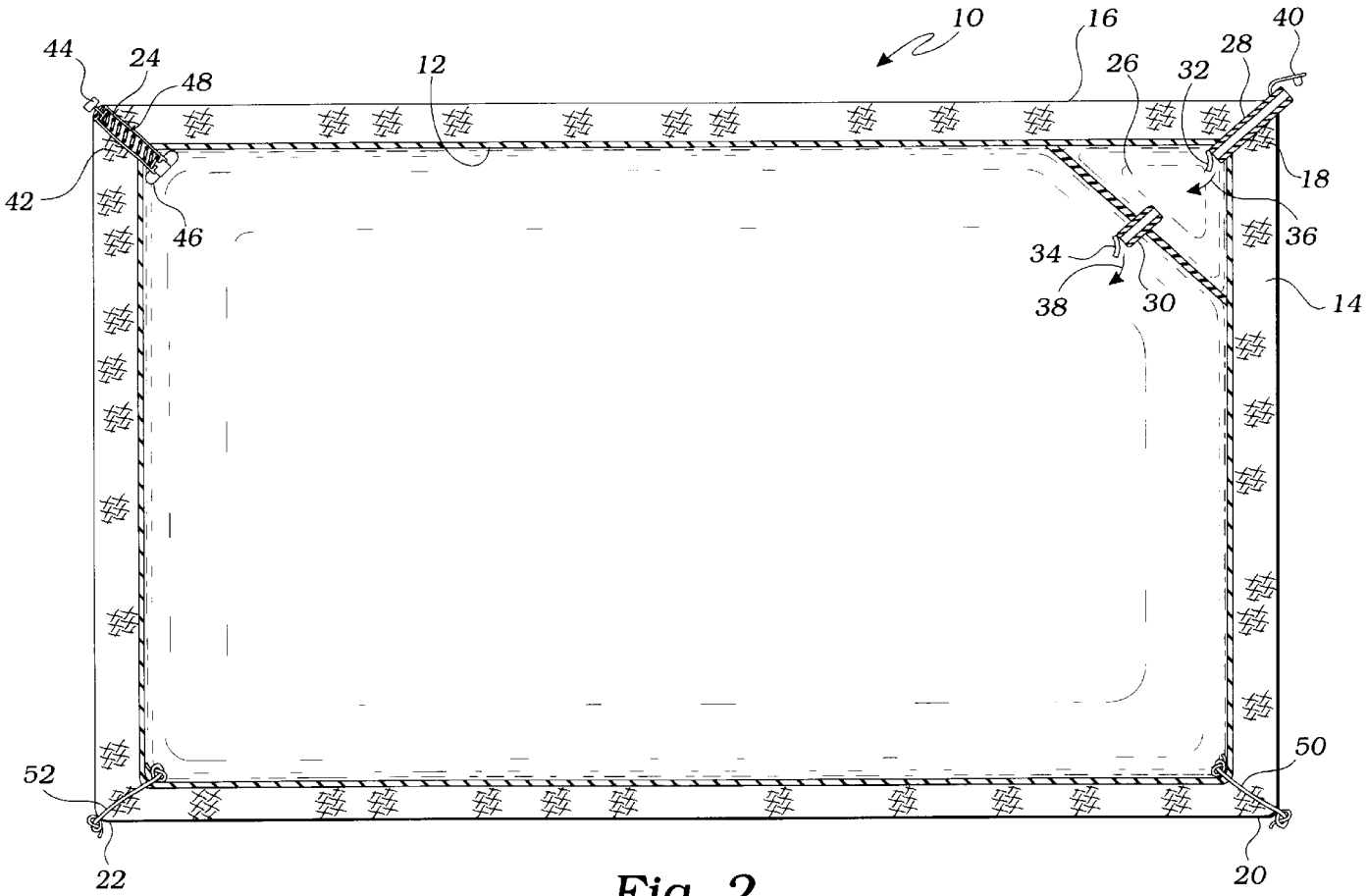
FIG. 2 is a cross-sectional view of the pillow of FIG. 1.
Figure 3:
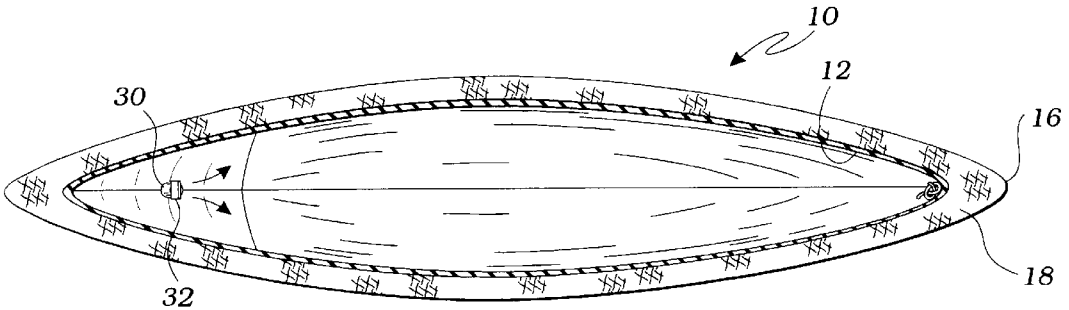
FIG. 3 is a further cross-sectional view of an inflated pillow of the present invention taken along line 3—3 of FIG. 1.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved inflatable pillow 10, comprised of a plurality of elements. The pillow 10 preferably includes an internal air bladder 12 made from plastic, rubber or the like, covered by a filling 14, held in place by an outer lining or casing 16. The air bladder 12 substantially fills the majority of the volume of the pillow with the filling 14 and lining 16 providing extra comfort and the look and feel of a standard pillow. The pillow 10 may be of any shape, however, is preferably substantially rectangular in general configuration, having four corners 18, 20, 22, 24. A first of these corners, such as 18, includes a pump or pumping section 26, formed integrally with or permanently secured to the inflatable inner bladder 12. The pump 26 includes a pair of air conduits or openings 28, 30, including check valves or flaps 32, 34 to provide air to an internal chamber in the bladder 12. Therefore, upon the pump being squeezed or actuated air is allowed to only flow into an internal cavity in pump 26 from opening 28 and out of the internal cavity via opening 30, in the direction of arrows 36, 38. A closure or sealing member 40 is used to block conduit 28 when the pillow is properly inflated for maximum comfort, or when the air bladder 12 is empty and the pillow is being stored or transported.

A second of the corners, such as 24, includes an air release valve 42 having a push or release button 44 and an inner valve 46, held in place by a spring 48. If the inflated pillow is too firm, or it is desired to deflate the pillow, the button 44 is pushed inwardly against the bias of the spring 48, to allow air to escape from the internal chamber in bladder 12.

To ensure that the filling 14 and casing or outer lining 16 remain in place around the air bladder 12, third and fourth corners of the air bladder 12 and pillow 10 such as 20, 22, include attaching means 50, 52, for securing the air bladder to the casing or lining. The attaching means 50, 52 may take any desired form, such as lines, tacks, or the like.

Figure 4:
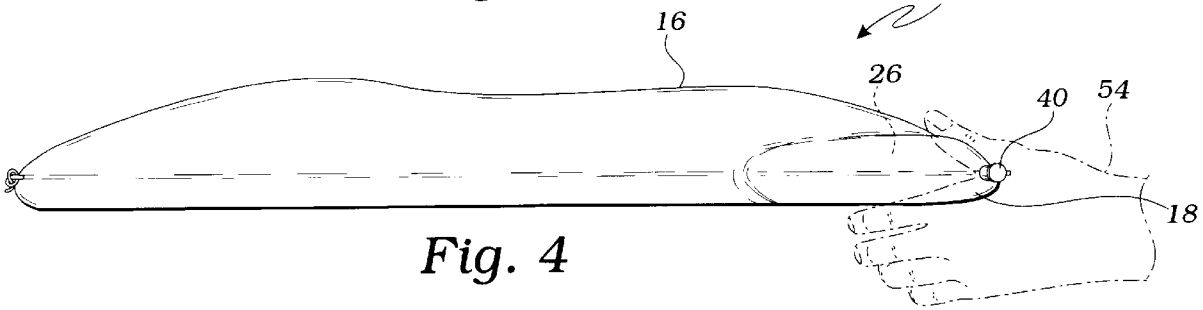
FIGS. 4 and 5 are side elevational views of the inflatable pillow of the present invention showing a hand operating the pump to inflate the pillow.
Figure 5:
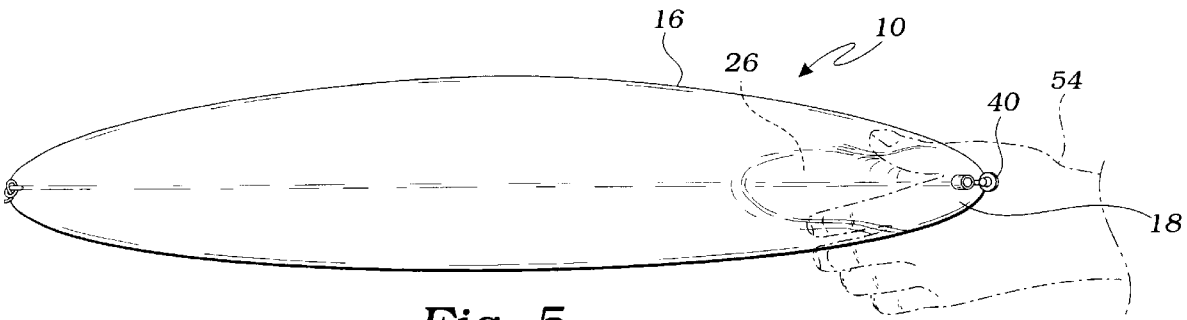

Turning now to FIGS. 4 and 5, a brief explanation of the operation of the pump 26 in inflating the bladder 12 and pillow 10 is presented. A hand 54 of a person lying on the pillow 10, or desiring to inflate the pillow for any reason, is placed on the corner 18 having the pump 26 therein (FIG. 4). If not opened, the closure 40 is opened and the pillow end 18 squeezed through the lining 16 and filling 14, to thereby squeeze the pump 26. With the closure 40 open, any air in the internal cavity of the pump will be forced into the internal chamber of the air bladder 12 through conduit 30 and check valve 34. Further air will be pulled or sucked into the internal cavity of the pump 26 upon release of pressure on the pump by hand 54. The pump 26 is operated until the air bladder 12 is inflated to provide the pillow 10 with the desired firmness required by the user. The closure 40 may then be closed and the pillow placed in a pillow case. The pillow case will not detract from or interfere with further use of the pump 26, or release valve 42.

It, therefore, can be seen that the present invention provides a new and improved, relatively low-cost, inflatable pillow, which is easily pumped up or may have air released therefrom to control its firmness and comfort of a user. The pump incorporated in the inflatable pillow allows a person to easily and quickly change the shape or firmness of the pillow without the need for any additional pumping means.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A method of forming an inflatable pillow, comprising the steps of:

forming an internal air bladder, having four corners;

securing a hand-operated air pump to a first corner of the air bladder;

securing an air release valve to a second corner of the air bladder; and covering the air bladder, hand operated air pump and air release valve with a filling and an outer lining.

2. The method of claim 1 including the further step of securing third and fourth corners of the air bladder to the filling and the outer lining.

3. The method of claim 2 including the further step of forming the hand-operated air pump integrally with the air bladder.

4. An inflatable pillow comprising:

an oblong shaped internal air bladder having four corners and an inner chamber;

a hand-operated air pump secured to a first of the four corners;

an air release valve secured to a second of the four corners;

a filling surrounding the internal air bladder, the hand-operated air pump and the air release valve;

an outer lining surrounding the filling; and third and fourth of the four corners being secured to the outer lining by attaching means passing through the filling.

5. The inflatable pillow of claim 4 wherein the hand-operated air pump is integrally formed with the internal air bladder and includes two air openings; a first of the two air openings being connected between the outer lining and an internal cavity formed in the hand-operated air pump; and the second of the two air openings being connected between the internal cavity formed in the hand-operated air pump and an inner chamber formed in the internal air bladder.

6. The inflatable pillow of claim 5, further including check valves held in the two air openings.

7. The inflatable pillow of claim 6 wherein the air release valve includes a push button operated valve member held therein.

8. The inflatable pillow of claim 4 wherein the air release valve includes a push button operated valve member held therein.

9. The inflatable pillow of claim 8 wherein the hand-operated air pump has a plurality of openings having check valves held therein.

* * * * *